US006209965B1

(12) United States Patent
Borns et al.

(10) Patent No.: US 6,209,965 B1
(45) Date of Patent: Apr. 3, 2001

(54) MARINE CLATHRATE MINING AND SEDIMENT SEPARATION

(75) Inventors: David J. Borns; Thomas E. Hinkebein; Richard W. Lynch; David A. Northrop, all of Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 09/209,219

(22) Filed: Dec. 10, 1998

Related U.S. Application Data

(60) Provisional application No. 60/093,317, filed on Jul. 20, 1998.

(51) Int. Cl.[7] ..... E02F 7/00

(52) U.S. Cl. ..... 299/8; 299/9; 299/17; 37/322; 37/329; 37/343

(58) Field of Search ..... 299/8, 9, 17; 37/317, 37/321, 322, 323, 329, 331, 333, 343

(56) References Cited

U.S. PATENT DOCUMENTS

| | | | | |
|---|---|---|---|---|
| 4,053,181 | * | 10/1977 | Saito | 299/9 |
| 4,322,897 | * | 4/1982 | Brassfield | 37/321 |
| 4,376,462 | | 3/1983 | Elliott et al. . | |
| 4,424,858 | | 1/1984 | Elliott et al. . | |
| 5,473,904 | | 12/1995 | Guo et al. . | |
| 5,660,603 | | 8/1997 | Elliot et al. . | |
| 5,950,732 | * | 9/1999 | Agee et al. | 299/8 |
| 5,970,635 | * | 10/1999 | Wilmoth | 37/323 |

OTHER PUBLICATIONS

Journal of Petroleum Geology, vol. 19(1), Jan. 1996, pp. 42–56, *Oceanic Methane Hydrates: A "Frontier" Gas Resource*, authored by Max, et al., (In Spec at P. 2).

*Methane Hydrate, A Special Clathrate: Its Attributes and Potential*, dated Feb. 28, 1997, (In Spec at P. 2).

*Oceanic Gas Hydrates: Guidance for Research and Programmatic Development*, Max, et al., Dec. 31, 1997 (In Spec at P. 2) .

*Natural Gas Hydrates: Artic and Nordic Sea Potential*, in Arctic Geology and Petroleum Potential, edited by T. O. Vorren, et al. (In Spec at P. 2).

"Marine and Continential Gas Hydrates: Development of a Potential Strategic Energy Source," Geosciences and Geotechnology Center, Sandia National Laboratories, Albuquerque, NM, white paper submitted to U.S. Senator Robert Graham, Jul. 31, 1997. (Discusses the clathrate resource and mining opportunities.)

* cited by examiner

*Primary Examiner*—Eileen D. Lillis
*Assistant Examiner*—John Kreck
(74) *Attorney, Agent, or Firm*—Russell D. Elliot; Kevin W. Bieg

(57) ABSTRACT

A method and apparatus for mining of hydrocarbons from a hydrocarbon-containing clathrate such as is found on the ocean floor. The hydrocarbon containing clathrate is disaggregated from sediment by first disrupting clathrate-containing strata using continuous mining means such as a rotary tilling drum, a fluid injector, or a drill. The clathrate-rich portion of sediment thus disrupted from the sea floor strata are carried through the apparatus to regions of relative lower pressure and/or relative higher temperature where the clathrate further dissociates into component hydrocarbons and water. The hydrocarbon is recovered with the assistance of a gas that is injected and buoys the hydrocarbon containing clathrate helping it to rise to regions of lower pressure and temperature where hydrocarbon is released. The sediment separated from the hydrocarbon returns to the ocean floor.

16 Claims, 4 Drawing Sheets

MARINE CLATHRATE MINING AND SEDIMENT SEPARATION

This application claims the benefit of U.S. Provisional Application No. 60/093,317, filed Jul. 20, 1998, and which is herein incorporated by reference in its entirety This invention was made with Government support under Contract DE-AC04-94AL85000 awarded by the U.S. Department of Energy. The Government has certain rights in the invention.

BACKGROUND OF THE INVENTION

1. Field of the Invention

This invention relates to the recovery of methane (natural gals) by sub-sea mining of clathrates.

2. Description of the Art Practices

U.S. Pat. No. 5,660,603 issued to Elliot et al., Aug. 26,1997 discusses a process for separating components of gas mixtures which have different hydrate forming characteristics using an aqueous liquid to absorb one of the gases preferentially by attaining conditions slightly above the catastrophic point at which gas hydrates form. Specifically, the separation of gas mixtures containing light hydrocarbons and carbon dioxide is accomplished without significantly reducing the pressure of the carbon dioxide or without requiring significant amounts of heat energy for regeneration.

U.S. Pat. No. 5,473,904 issued Dec. 12, 1995 to Guo et al., discloses a method of forming clathrate hydrates further by pressurizing a hydrate-forming gas, cooling liquid water below the gas-water-hydrate equilibrium curve, combining the hydrate-forming gas and the liquid water while locally supercooling the gas, and thereby forming a clathrate hydrate.

U.S. Pat. No. 4,376,462 issued Mar. 15, 1983 to Elliott et al., describes a method and apparatus for producing gaseous hydrocarbons from formations comprising solid hydrocarbon hydrates located under either a body of land or a body of water. In the Elliott et al., process warm brine or water brought down from an elevation above that of the hydrates, through a portion of the apparatus, passes in contact with the hydrates and melts them. The liquid then continues up another portion of the apparatus, carrying entrained hydrocarbon vapors in the form of bubbles, which can easily be separated from the liquid. After a short startup procedure, the process and apparatus are substantially self-powered by virtue of pressure differences. A related disclosure to U.S. Pat. No. 4,376,462 issued Mar. 15, 1983 to Elliott et al., is found in Elliott et al., in U.S. Pat. No. 4,424,858 issued Jan. 10, 1984.

An article in the Journal of Petroleum Geology, vol. 19(1). January 1996, pp. 41–56 *OCEANIC METHANE HYDRATES: A "FRONTIER" GAS RESOURCE* authored by Max et al., discusses the chemistry of methane hydrates. Max et al., article discloses that methane hydrates are ice-like compounds consisting of natural gas (mainly methane) and water, whose crystal structure effectively compresses the methane; each cubic meter of hydrate can yield over 150 cubic meters of methane. The hydrates cement sediments and impart considerable mechanical strength; the fill porosity and restrict permeability.

An article entitled *Methane Hydrate, A Special Clathrate: Its Attributes and Potential* by Max et al., dated Feb. 28, 1997 discusses the recovery and processing of methane hydrate. Similar disclosures are also made by Max et al., in an article entitled *Oceanic Gas Hydrate: Guidance for Research and Programmatic Development* for work done at the Naval Research Laboratory bearing a date of Dec. 31, 1997. Further disclosures are made by Max et al., in a chapter entitled *Natural gas hydrates: Arctic and Nordic Sea potential in Arctic Geology and Petroleum Potential* edited by T. O. Vorren et al.

The need remains for effective processes to be developed to allow the hydrocarbon gas trapped in the ice like stricture of the clathrate and the sediment to be effectively mined and separated. The present invention deals with one such effective method of the recovery of the hydrocarbon gases from the sea floor.

To the extent that the foregoing references are relevant to the present invention, they are herein specifically incorporated by reference. Measurements herein are stated in degrees of approximation and where appropriate the word "about" may be inserted before any measurement.

SUMMARY OF THE INVENTION

Described herein is an apparatus, according to the present invention, for recovering hydrocarbons from a hydrocarbon containing clathrate, the apparatus comprising:

- mining means, for when said apparatus is in operation, disrupting a clathrate rich portion comprising the hydrocarbon containing clathrate and sediment from the surrounding strata,
- transporting means for moving a clathrate rich portion comprising the hydrocarbon containing clathrate and sediment,
- conduit means for receiving the hydrocarbon containing clathrate and sediment; and,
- injection means having a point of injection for injecting an injection gas into said conduit.

Also described is a pressure- and/or temperature-related method of recovering hydrocarbons from a hydrocarbon-containing clathrate including the steps of:

- disrupting a clathrate rich portion comprising the hydrocarbon containing clathrate and sediment from the surrounding strata,
- transporting said clathrate rich portion into a conduit, said conduit extending between a first region of high pressure and a second region of lower pressure,
- injecting an injection gas into said conduit to aid in moving said clathrate rich portion from the region of high pressure to the region of low pressure,
- separating at least a portion of the sediment in said clathrate rich portion from said hydrocarbon containing clathrate; and,
- recovering said hydrocarbon from said hydrocarbon containing clathrate.

The present invention further describes a temperature-related method of recovering hydrocarbons from a hydrocarbon-containing clathrate including the steps of:

- disrupting a clathrate rich portion comprising the hydrocarbon containing clathrate and sediment from the surrounding strata,
- transporting said clathrate rich portion into a conduit, said conduit extending between a first region of low temperature and a second region of high temperature,
- injecting an injection gas into said conduit to aid in moving said clathrate rich portion from the region of low temperature to the region of high temperature,
- separating at least a portion of the sediment in said clathrate rich portion from said hydrocarbon containing clathrate; and, recovering said hydrocarbon from said hydrocarbon containing clathrate.

BRIEF DESCRIPTION OF THE DRAWINGS

The foregoing and other features of the present invention will become apparent to one skilled in the art to which the present invention relates upon consideration of the following description of the invention with reference to the accompanying drawings. The drawings, which are incorporated into and form a part of the specification, illustrate embodiments of the present invention, and together with the description, serve to explain the principles of the invention. The drawings are only for the purpose of illustrating preferred embodiments of the invention and are not to be construed as limiting the invention. In the drawings:

FIG. 1 shows the basic design of an apparatus, according to the present invention, for recovering a hydrocarbon from a hydrocarbon containing clathrate.

DETAILED DESCRIPTION OF THE INVENTION

As previously discussed, the invention deals with recovering hydrocarbons from hydrocarbon-containing clathrate. Generally, the invention involves mechanically mining the clathrate (comprising, for example, hydrocarbon hydrate) using means for disrupting clathrate-rich sediments found at or near the surface of the sea floor. Such mechanical mining can be accomplished in any of a variety of ways consistent with the principles set forth in this disclosure. Among these ways are included various continuous mining techniques including, for example, grinding using a rotary tilling drum, and blasting high-pressure fluid against the surfaces of strata located at the sea floor, and drilling. Two of these approaches are illustrated as preferred embodiments, below. The embodiments are intended to be illustrative although not limitative of the principles of the invention.

According to the invention, sediments including clathrate-rich material disturbed from the sea floor are carried upward, with the aid of injection gas. As the disturbed material travels upward through regions of decreasing pressure, increasing temperature, or both, the clathrates and sediment separate and gaseous hydrocarbons are liberated as the clathrates dissociate. Sediments eventually fall and return to the sea floor. Gaseous hydrocarbons freed from the clathrates are collected by methods well known to those skilled in the art of offshore gas recovery. The water component and other non-gaseous-hydrocarbon components of the former clathrates remain in the sea water.

Figure 1A:
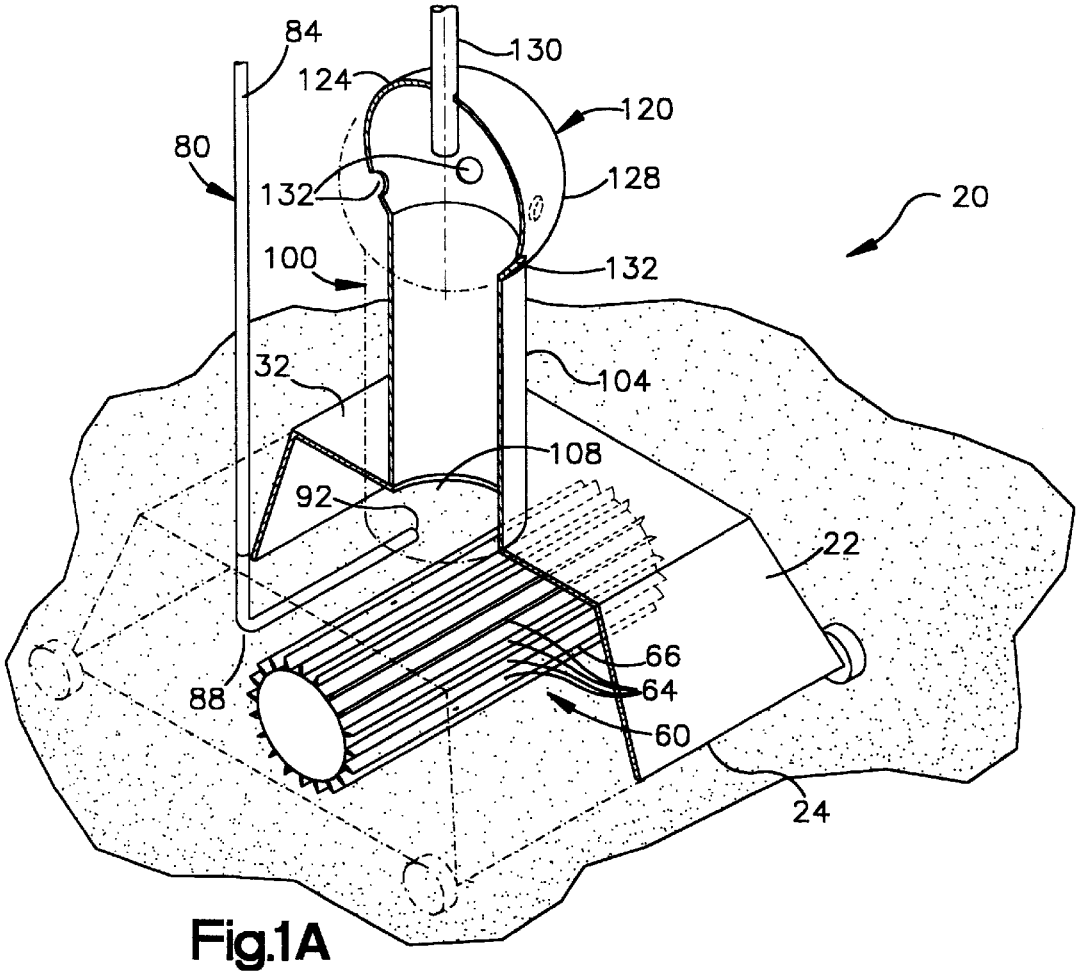
FIG. 1A shows the point of injection of the supply gas below the point at which the conduit receives the hydrocarbon.
Figure 1B:
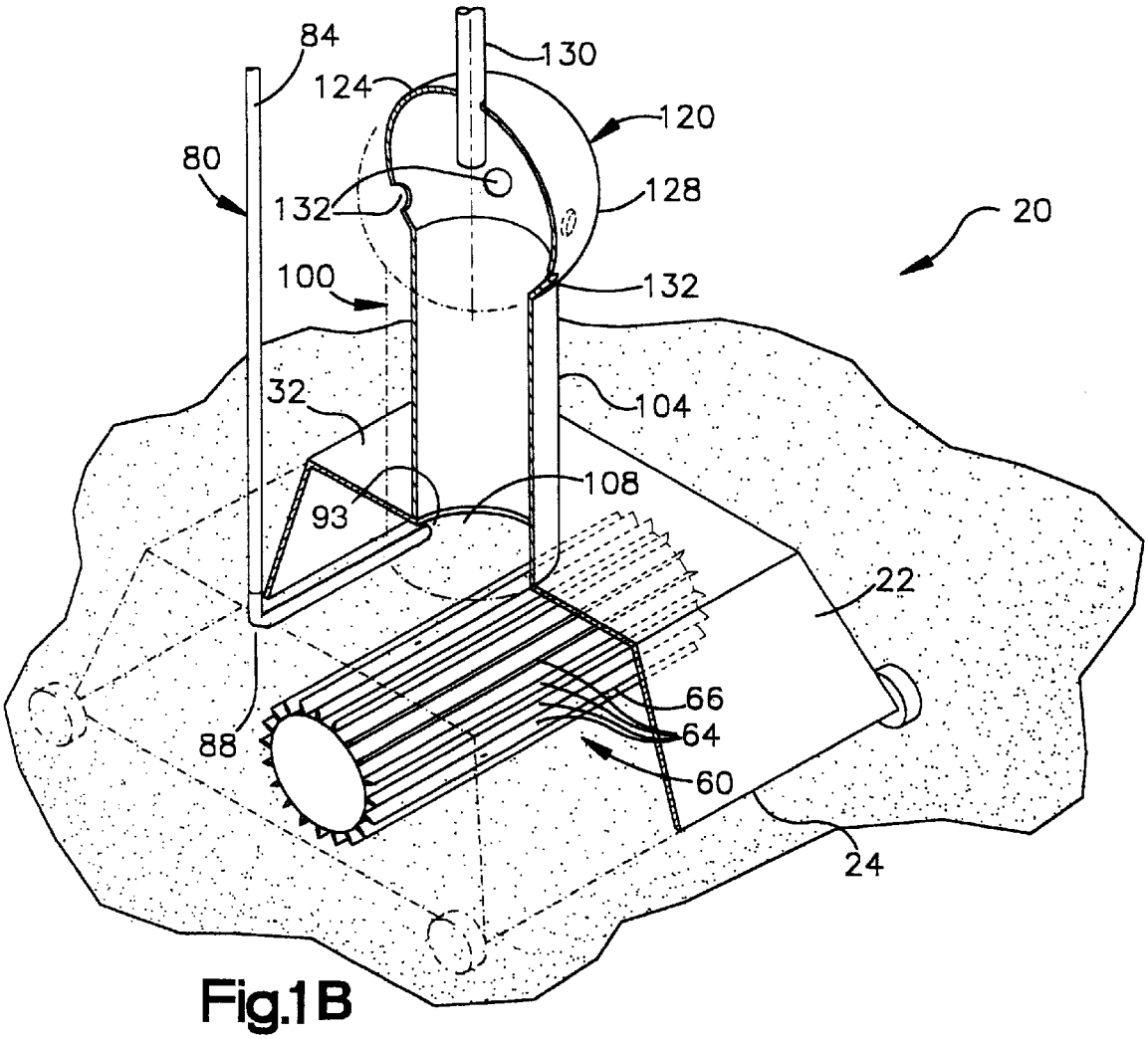
FIG. 1B shows the point of injection at the hydrocarbon-receiving point.
Figure 1C:
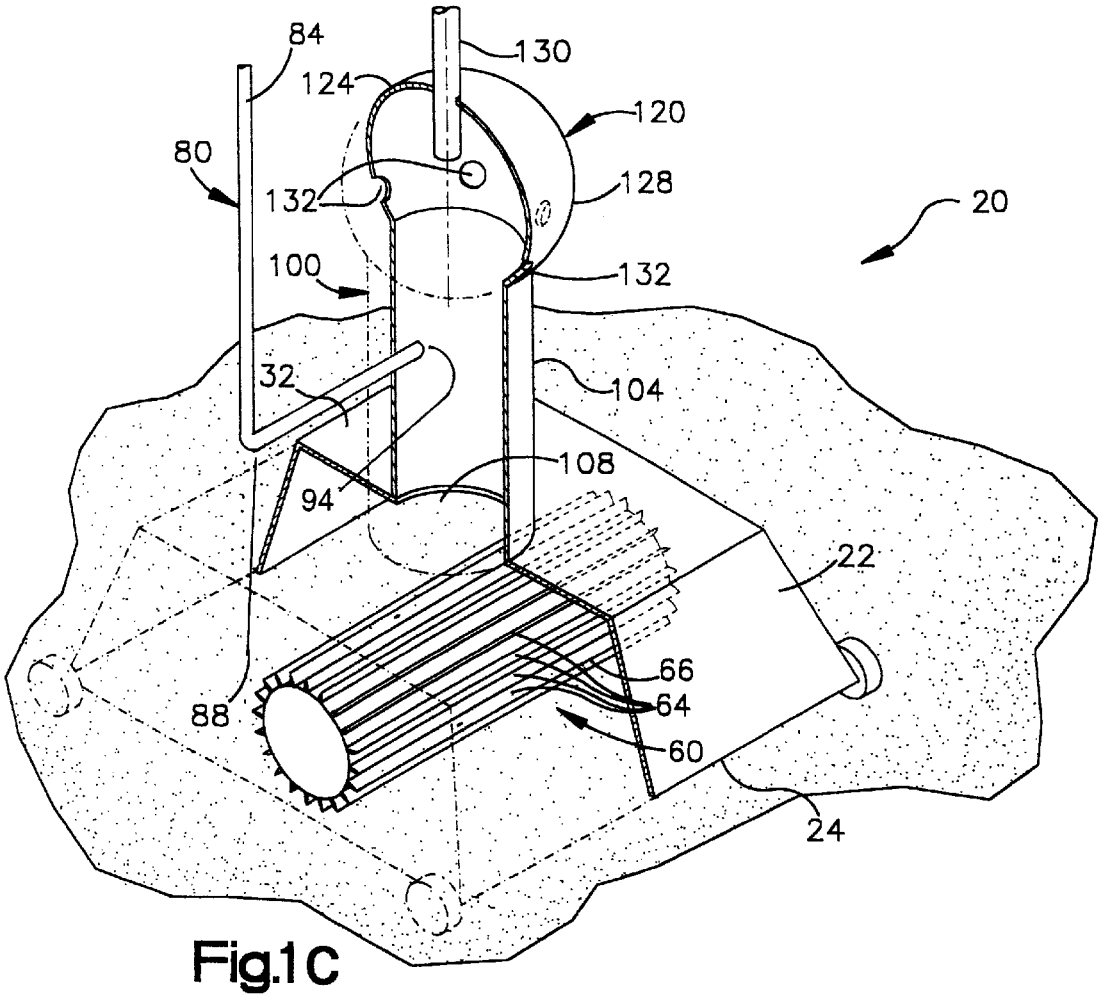
FIG. 1C shows the injection point above the hydrocarbon-receiving point.

FIG. 1 illustrates one of the preferred embodiments. The subsea platform 20 has, for example, a three-dimensional generally trapezoidal base 22 wherein four generally trapezoidal sides are adjoined to an upper surface 32 and form an enclosure that is open in a plane generally defined by the lower edges 24 of the four sides (as described in greater detail below). However, a differently-shaped enclosure of any size and shape suited to the invention principles, including a three-dimensional generally rectangular enclosure or a generally cylindrical enclosure, could be used in place of the three-dimensional generally trapezoidal base 22 without departing from the intended scope of the invention.

In the embodiment illustrated in FIG. 1, the four sides of the three-dimensional generally trapezoidal base 22 of the subsea platform 20 are of approximately equal dimensions. The lower edges 24 of the four sides of the subsea platform 20 combine to form generally a square. The area enclosed by the perimeter defined by the lower edges 24 of the four sides of the subsea platform 20 is open to permit, when the apparatus is in operation, free access to the sea floor. In this embodiment, the area enclosed by the perimeter defined by the lower edges 24 of the four sides is greater than the surface area of the upper surface 32.

As shown in the Figure, the subsea platform 20 has an upper surface 32. The upper surface 32 of the subsea platform 20 is generally square. The upper surface 32 of the subsea platform 20 is substantially air tight. It is possible, consistent with the principles of the invention to substitute in place of a planar upper surface 32, any substantially air tight upper region through which may pass the features below described as passing through the upper surface 32. One possible option includes having a dome-shaped upper region.

Across two opposing sides of the subsea platform 20 is mounted a rotary tilling drum 60. In other embodiments wherein differently-shaped enclosures are employed as the platform 20, the drum 60 can be mounted in various orientations so that the drum is extends substantially across the platform base 20 in a plane generally parallel to that defined by the open portion of the platform. The rotary tilling drum 60 has a series of cutting surfaces, which in the preferred embodiment are helical cutting surfaces 64. An example of such helical cutting surfaces is what are known to those skilled in the art of continuous mining as "endless helical cutting surfaces." The helical cutting surfaces 64 of the rotary tilling drum 60 each have an outer surface 66. The outer surfaces 66 of the helical cutting edge, when rotated to the lowermost position in the operational orientation of the apparatus, extend slightly below the plane formed by the lower surface 24 of each of the four lower edges of the three-dimensional generally trapezoidal base 22.

A power source (not shown) provides power to turn the rotary tilling drum 60. In the preferred embodiment, the power source also provides power for the subsea platform 20 to move across the sea floor.

An injection gas supply line 80 extends through the upper surface 32 of subsea platform 20. An upper region 84 of the injection gas supply line 80 connects with a supply of gas (not shown). A lower region 88 of the injection gas supply line 80 connects with the upper region 84 of the injection gas supply line 80 to permit, when in operation, communication of the gas from the upper region 84 of the injection gas supply line 80 to the lower region 88 of the injection gas supply line 80. In the embodiment of the invention shown in FIG. 1A, an opening 92 in the lower region 88 of the injection gas supply line 80 is within the confines of the three-dimensional generally trapezoidal base 22. In cases where differently shaped enclosures are used, the lower region 88 of the injection gas supply line 80 is similarly within the confines of the enclosure. In another embodiment of the invention, shown in FIG. 1B, the opening 93 for injecting the gas supply is at the point at which the conduit receives the hydrocarbon. In yet another embodiment of the invention, shown in FIG. 1C, the point of injection 94 is above the point at which the conduit receives the hydrocarbon.

A conduit 100 is connected with the upper surface 32 of subsea platform 20. The conduit 100 preferably has a generally cylindrical lower conduit segment 104. The generally cylindrical lower conduit segment 104 has an opening 108. The generally cylindrical lower conduit segment 104 communicates with the confines of the base 22 by means of the opening 108.

The conduit 100 includes an intermediate chamber 120, which in the preferred instance is generally spherical. The intermediate chamber 120 shown illustrated in the Figure has a larger diameter than the conduit 100. The generally spherical intermediate chamber 120 has an upper half 124 and a lower half 128. The upper half 124 of the generally spherical intermediate chamber 120 is substantially air tight.

The lower half 128 of the generally spherical intermediate chamber 120 has a series of port openings 132. The series of port openings 132 permit, when the apparatus is in operation, communication between the lower half 128 of the spherical intermediate chamber 120 and the surrounding sea.

In the operative orientation of the apparatus, the generally spherical intermediate chamber 120 is positioned above the generally cylindrical lower conduit segment 104. The generally spherical intermediate chamber 120 communicates with the generally cylindrical lower conduit segment 104.

A generally cylindrical upper conduit segment 130 is connected with the generally spherical intermediate chamber 120. The generally spherical intermediate chamber 120 communicates with the generally cylindrical upper conduit segment 130. The generally cylindrical upper conduit segment 130 extends to the surface of the sea. In the region of the surface of the sea the generally cylindrical upper conduit segment 130 connects with a compressor (not shown).

The purpose of the present invention is the recovery of a hydrocarbon from a hydrocarbon containing clathrate. In operation, the three-dimensional generally trapezoidal base 22 of subsea platform 20 rests on the sea floor in an area determined to be rich in the desired hydrocarbon containing clathrate.

The power source (not shown) provides power to turn the rotary tilling drum 60. The turning of the rotary tilling drum 60 causes the series of helical cutting surfaces 64 to turn. The outer surfaces 66 of helical cutting surfaces 64 contact the strata on the sea floor. The strata comprise the hydrocarbon containing clathrate and sediment. The hydrocarbon containing clathrate is largely hydrocarbon and water. The hydrocarbon is mostly methane, propane, isopropane, butane, isobutane, pentane and isomers of pentane.

The turning of the rotary tilling drum 60 comminutes the strata into fragments of the clathrate and sediment to generate a clathrate rich portion. Larger rocks and other sea floor debris are not affected by the turning of the rotary tilling drum 60.

The turning of the rotary tilling drum 60 provides upward movement (toward the surface of the sea) of the clathrate rich portion. The currents generated by the turning of the rotary tilling drum 60 sweep the clathrate rich portion toward the opening 108 in the generally cylindrical lower conduit segment 104. In the preferred embodiment, the three-dimensional generally trapezoidal configuration of the base 22 is beneficial in that the angle of the sides in relation to the sea floor may assist in channeling the clathrate-rich portion toward the generally cylindrical lower conduit segment 104.

The injection gas supply line 80 is opened a short time before or after or at the time the rotary tilling drum 60 begins operation. The injection gas utilized in the injection gas supply line 80 is conveniently methane, propane, isopropane, butane, isobutane, pentane and isomers of pentane. Compressed air supplied either by a line from the surface or from storage tanks on the subsea platform can also be utilized in place of the gases just mentioned. The injection gas used in the injection gas supply line 80 is conveniently a portion of the hydrocarbon gas recovered from the process of the present invention. Although gases such as compressed air, nitrogen, carbon dioxide and combustion gases generated from burning hydrocarbon may be employed herein, such gases would have to be separated from the hydrocarbon gases recovered from the clathrate rich portion, or maintained at satisfactorily low levels so as not to significantly reduce the value of the recovered gases. In the case wherein compressed air is used, precautions known to those skilled in the art of hydrocarbon extraction must be taken to avert combustion hazards.

The injection gas supply line 80 provides a supply of injection gas from the surface of the sea through the upper region 84 of the injection gas supply line 80 to lower region 88 of the injection gas supply line 80. The injection gas from the lower region 88 of the injection gas supply line 80 exits an opening 92 in the lower region 88 of the injection gas supply line 80. The injection gas which exits the opening 92 in the lower region 88 of the injection gas supply line 80 enters the confines of the base 22.

The injection gas exiting the opening 92 in the lower region 88 of the injection gas supply line 80 aids in sweeping the comminuted fragments of the clathrate and sediment from the strata toward the opening 108 in the generally cylindrical lower conduit segment 104. The injection gas from the injection gas supply line 80 then aids in transporting the comminuted fragments of the clathrate and sediment from the strata upward (toward the sea surface).

The clathrate ordinarily begins to decompose as the ambient pressure is reduced or the ambient temperature increases. Typically, the pressure will be reduced by about one atmosphere for each 10 meters that the clathrate rich portion rises toward the sea surface. The temperature will also generally rise as the clathrate rich portion rises toward the sea surface.

Thus, as the clathrate rich portion rises toward the sea surface within the generally cylindrical lower conduit segment 104 it begins to generate the hydrocarbon gas and water. As the clathrate rich portion generates the hydrocarbon gas, this added source of hydrocarbon gas aids in carrying the clathrate rich portion toward the surface.

The sediment loosely adhering to the clathrate begins to separate as the ambient temperature rises or the ambient pressure decreases. The clathrate rich portion continues to rise and is largely decomposed before it enters the generally spherical intermediate chamber 120. The generally spherical intermediate chamber 120 has a larger diameter than the lower conduit 100. The generally spherical intermediate chamber 120 is an area of turbulent flow due to the increase in diameter and change in flow direction. The generally spherical intermediate chamber 120 is provided to allow disengagement of gas from sediment particles.

The liquid and sediment particles flow out of the series of port openings 132 in the lower half 128 of the generally spherical intermediate chamber 120. Sediment that passes through the series of port openings 132 falls back to the sea floor by gravitational force. Some sediment is also likely to fall back into the generally cylindrical lower conduit segment 104 and ultimately to the sea floor.

The series of port openings 132 also serves a safety function. If the partial pressure of the gas generated from the clathrate and the partial pressure of the injection gas are too great the conduit 100 may rupture. While the pressure of the injection gas may be controlled it is much more difficult to control the gas generated from the clathrate. Thus, if the total gas pressure in the generally spherical intermediate chamber 120 is too great, venting of the gas is permitted through series of port openings 132.

The power source also preferably provides power for the subsea platform 20 to move across the sea floor. As a consequence of the subsea platform 20 moving across the sea floor, new areas may be mined for the clathrate while the sediment is deposited.

Figure 2:
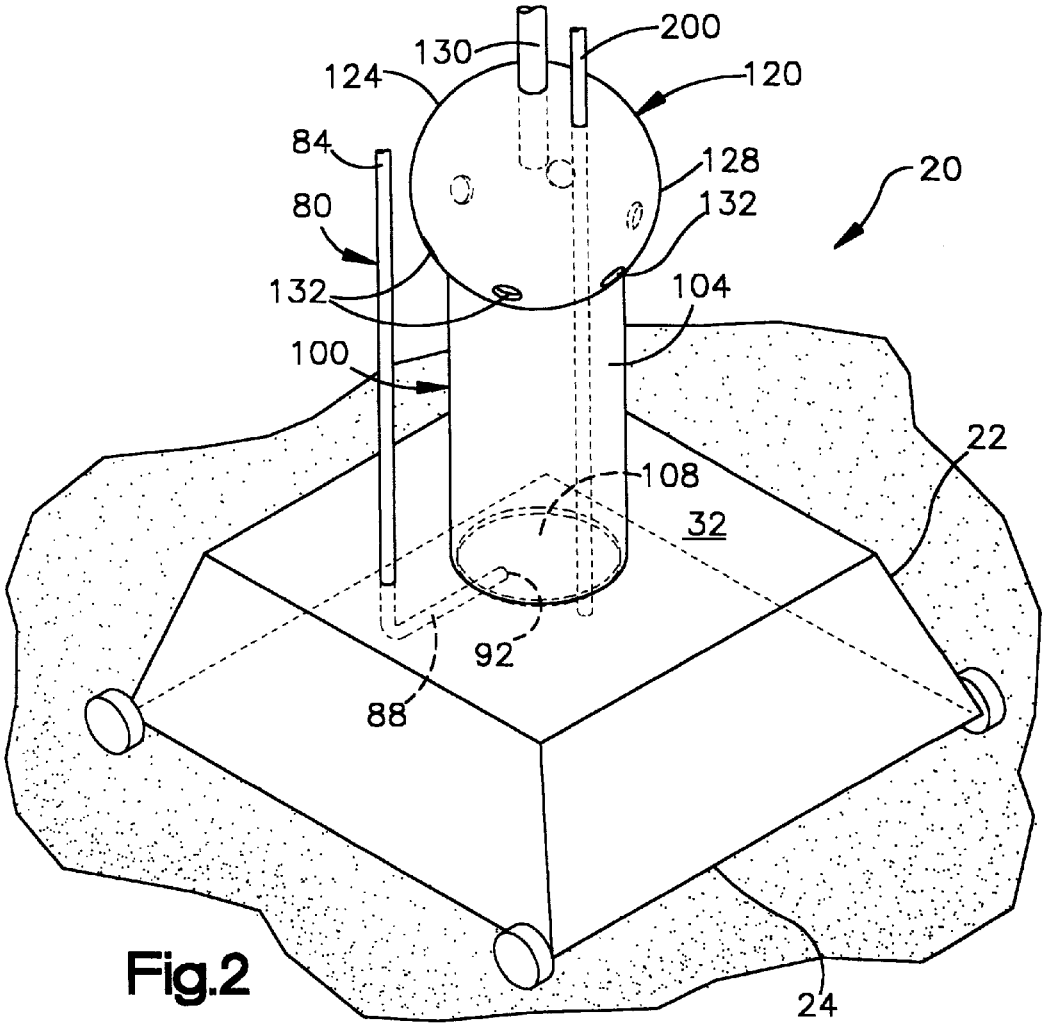
FIG. 2 shows a second embodiment of an apparatus, according to the present invention, for recovering a hydrocarbon from a hydrocarbon containing clathrate.

A second embodiment of the invention is shown in FIG. 2. Although the apparatus of the second embodiment is generally similar to the first embodiment a different mechanism is employed for disrupting the clathrate rich portion of the clathrate-containing strata The subsea platform 20 has a base 22 similar to that described for the previously disclosed embodiment, with features including sides and an upper surface 32, generally describing an enclosure that is open to the sea floor. Again, various other enclosure configurations will fall within the scope of the invention and appended claims, as described above for the previous embodiment exemplified by FIG. 1.

In this embodiment instead of the using a rotating drum, the apparatus includes a fluid jet tube 200 which may extend substantially from the sea surface through the upper surface 32 of the subsea platform 20. Alternatively, the fluid jet tube could extend from a location below the sea surface, for example, in a case wherein the fluid to be used in the jet tube is seawater. An example of this case is using a pump located in the region of the platform 20 wherein water is pumped from the environment near the sea floor into the fluid jet tube 200 and carried into the enclosure beneath the platform via the opening 92. In all cases, though, the fluid jet tube 200 is connected with a source of fluid. This fluid is typically a liquid, preferably aqueous in nature.

The fluid jet tube 200 preferably extends from the fluid source (not shown) to about one-half meter above the sea floor. The fluid in the fluid jet tube 200 is supplied under pressure. The supply pressure for the fluid in the fluid jet tube 200 is conveniently from about 2 to about 1,000 times the ambient pressure of the sea floor that is being mined.

Certain other features illustrated in FIG. 2 are similar in orientation, structure and function to analogous features described above in conjunction with the embodiment shown in FIG. 1. Major features include an injection gas supply line 80 (with the associated features previously described), a conduit 100 (likewise with the associated features previously described) and the generally spherical intermediate chamber 120.

In the embodiment illustrated in FIG. 2, a compressor (not shown) provides fluid to the fluid jet tube 200 at conveniently from about 2 to about 1,000 times the ambient pressure of the sea floor that being mined. The fluid from the fluid jet tube 200 disaggregates the strata on the sea floor. As mentioned previously, the strata comprise the hydrocarbon-containing clathrate and sediment. The hydrocarbon-containing clathrate is largely hydrocarbon and water. Also as previously described, the hydrocarbon is mostly methane, propane, isopropane, butane, isobutane, pentane and isomers of pentane. The currents generated by the fluid from the fluid jet tube 200 sweep the clathrate rich portion toward the opening 108 in the generally cylindrical lower conduit segment 104.

The injection gas supply line 80 is opened either a short time after or before or at the same time as the fluid jet tube 200 begins operation. Injection gas performs the same function in the same way as described above regarding FIG. 1, wherein it aids in transporting comminuted fragments of the cathrate and sediment from the strata upward (toward the sea surface). In this embodiment, decomposition of the clathrate, separation from sediment and collection of hydrocarbon gas is the same as previously described.

The two described embodiments (one using a rotary tilling drum, and the other using a fluid jet tube) are examples of how the principles of the invention apply in two different types of continuous mining applications. Other continuous mining applications capable of disrupting clathrate rich strata on the sea floor are known to those skilled in the art of continuous mining. Such other continuous mining applications as are suited to the principles of the invention are intended to fall within the scope of the appended claims.

From the above description of the invention, those skilled in the art will perceive improvements, changes and modifications. Such improvements, changes and modifications are intended to be within the scope of the following claims.

We claim:

1. An apparatus for recovering hydrocarbons from a hydrocarbon-containing clathrate, said apparatus comprising:

mining means for disrupting a clathrate rich portion comprising the hydrocarbon-containing clathrate and sediment from the surrounding strata;

transporting means for moving a clathrate rich portion comprising the hydrocarbon-containing clathrate and sediment;

a conduit adapted for receiving the hydrocarbon containing clathrate and sediment and further adapted for separating said sediment from said hydrocarbon, wherein said conduit has a diameter, a first end, a second end and is generally cylindrical, and wherein said conduit has an intermediate portion located between the first end and the second end, and said intermediate portion has a greater diameter than the first end; and injection means having a point of injection for injecting an injection gas into said conduit.

2. The apparatus according to claim 1 wherein said point of injection for injecting an injection gas into said conduit is, when the apparatus is in its operative orientation, selected from the group consisting of at, below, and above the point at which the conduit receives the hydrocarbon containing clathrate and sediment.

3. The apparatus according to claim 1 wherein said mining means is a continuous miner selected from the group consisting of a mechanism comprising a rotary tilling drum and a mechanism comprising a fluid injector.

4. The apparatus according to claim 1 wherein said intermediate portion has a greater diameter than the second end.

5. A method of recovering hydrocarbons from a hydrocarbon-containing clathrate including the steps of:

disrupting a clathrate rich portion comprising the hydrocarbon-containing clathrate and sediment from the surrounding strata;

transporting said clathrate rich portion into a conduit;

said conduit extending between a first region of relative higher pressure and a second region of relative lower pressure and wherein said conduit has an intermediate portion located between the region of relative higher pressure and the region of relative lower pressure, and said intermediate portion has a greater diameter than the first region of higher pressure, injecting an injection gas into said conduit to aid in moving said clathrate rich portion from the region of relative higher pressure to the region of relative lower pressure, separating at least a portion of the sediment in said clathrate rich portion from said hydrocarbon containing clathrate; and recovering said hydrocarbon from said hydrocarbon containing clathrate.

6. The method of claim 5 wherein said injection gas is a hydrocarbon gas.

7. The method of claim 5 wherein said injection gas is injected into the region of relative higher pressure at a pressure greater than that of the region of relative higher pressure.

8. The method of claim 5 wherein the region of relative lower pressure extends substantially to sea level.

9. The method of claim 5 wherein said injection gas comprises a gas selected from the group consisting of compressed air, nitrogen, carbon dioxide, hydrocarbon gases and combustion gases.

10. The method of claim 5 wherein said intermediate portion has a greater diameter than the second region of lower pressure.

11. A method of recovering hydrocarbons from a hydrocarbon-containing clathrate including the steps of:

disrupting a clathrate-rich portion comprising the hydrocarbon-containing clathrate and sediment from the surrounding strata;

transporting said clathrate-rich portion into a conduit, said conduit extending between a first region of relative lower temperature and a second region of relative higher temperature and wherein said conduit is generally cylindrical, has a first end, a second end, and an intermediate portion located between the first end and the second end, and the intermediate portion has a greater diameter than the first end;

injecting an injection gas into said conduit to aid in moving said clathrate rich portion from the region of relative lower temperature to the region of relative higher temperature, separating at least a portion of the sediment in said clathrate rich portion from said hydrocarbon containing clathrate; and recovering said hydrocarbon from said hydrocarbon containing clathrate.

12. The method of claim 11 wherein said injection gas comprises a hydrocarbon gas.

13. The method of claim 11 wherein said injection gas is injected into the region of relative lower temperature at a pressure greater than the ambient pressure in the region of relative lower temperature.

14. The method of claim 11 wherein said injection gas is injected at a location selected from the group consisting of at, below, and above the point at which the conduit receives the hydrocarbon containing clathrate and sediment.

15. The method of claim 11 wherein the intermediate portion has a greater diameter than the second end.

16. The method of claim 11 wherein said injection gas comprises a gas selected from the group consisting of compressed air, nitrogen, carbon dioxide, hydrocarbon gases and combustion gases.

* * * * *